US010830230B2

(12) United States Patent
Hahn et al.

(10) Patent No.: US 10,830,230 B2
(45) Date of Patent: Nov. 10, 2020

(54) METHOD FOR OPERATING A LINEAR COMPRESSOR

(71) Applicants: Haier US Appliance Solutions, Inc., Wilmington, DE (US); University of Louisville Research Foundation, Inc., Louisville, KY (US)

(72) Inventors: Gregory William Hahn, Louisville, KY (US); Srujan Kusumba, Louisville, KY (US); Michael Lee McIntyre, Louisville, KY (US); Joseph W Latham, Louisville, KY (US)

(73) Assignees: Haier US Appliance Solutions, Inc., Wilmington, DE (US); University of Louisville Research Foundation, Inc., Louisville, KY (US)

( * ) Notice: Subject to any disclaimer, the term of this patent is extended or adjusted under 35 U.S.C. 154(b) by 125 days.

(21) Appl. No.: 15/397,770

(22) Filed: Jan. 4, 2017

(65) Prior Publication Data

US 2018/0187674 A1 Jul. 5, 2018

(51) Int. Cl.
*F04B 49/16* (2006.01)
*F04B 35/04* (2006.01)
(Continued)

(52) U.S. Cl.
CPC ..... *F04B 49/16* (2013.01); *F04B 35/04* (2013.01); *F04B 39/121* (2013.01); *F04B 49/06* (2013.01);
(Continued)

(58) Field of Classification Search
CPC ..... F04B 49/16; F04B 53/008; F04B 49/06; F04B 39/121; F04B 35/04; F04B 49/20; F04B 2203/00
See application file for complete search history.

(56) References Cited

U.S. PATENT DOCUMENTS 3,782,859 A 1/1974 Schuman
4,291,258 A 9/1981 Clark et al.
(Continued)

FOREIGN PATENT DOCUMENTS

EP 0620367 4/1993
EP 2686554 A2 1/2014
(Continued)

OTHER PUBLICATIONS

Chen, etc., Accurate Motion Control of Linear Motors with Adaptive Robust Compensation of Nonlinear Electromagnetic Field Effect, Proceedings of the ASME 2011 Dynamic Systems and Control Conference (Year: 2011).*
(Continued)

*Primary Examiner* — Patrick Hamo
*Assistant Examiner* — David N Brandt
(74) *Attorney, Agent, or Firm* — Dority & Manning, P.A.

(57) ABSTRACT

A method for operating a linear compressor includes establishing a set of predictors, and establishing a model for an estimated head clearance of the linear compressor with the set of predictors. Coefficients of the model for the estimated head clearance of the linear compressor may also be established. The model for the estimated head clearance of the linear compressor may be used to calculate an estimated head clearance during operation of the linear compressor.

17 Claims, 8 Drawing Sheets

(51) Int. Cl.

| | |
|---|---|
| ***F04B 39/12*** | (2006.01) |
| ***F04B 49/20*** | (2006.01) |
| ***F04B 49/06*** | (2006.01) |
| ***F04B 53/00*** | (2006.01) |

(52) U.S. Cl.

CPC ..... *F04B 49/065* (2013.01); *F04B 49/20* (2013.01); *F04B 53/008* (2013.01); *F04B 2203/00* (2013.01)

(56) References Cited

U.S. PATENT DOCUMENTS

| | | | | |
|---|---|---|---|---|
| 4,353,220 | A | 10/1982 | Curwen et al. | |
| 4,538,964 | A | 9/1985 | Brown | |
| 5,146,124 | A | 9/1992 | Higham et al. | |
| 5,342,176 | A | 8/1994 | Redlich | |
| 5,381,092 | A * | 1/1995 | Freedman | G01N 24/081 324/303 |
| 5,496,153 | A | 3/1996 | Redlich | |
| 5,525,845 | A | 6/1996 | Beale et al. | |
| 5,598,076 | A | 1/1997 | Neubauer et al. | |
| 5,818,131 | A | 10/1998 | Zhang | |
| 5,944,302 | A | 8/1999 | Loc et al. | |
| 5,980,211 | A | 11/1999 | Tojo et al. | |
| 6,231,310 | B1 | 5/2001 | Tojo et al. | |
| 6,247,900 | B1 | 6/2001 | Archibald et al. | |
| 6,289,680 | B1 | 9/2001 | Oh et al. | |
| 6,753,665 | B2 | 6/2004 | Ueda et al. | |
| 6,811,380 | B2 | 11/2004 | Kim | |
| 6,812,597 | B2 | 11/2004 | McGill et al. | |
| 6,883,333 | B2 | 4/2005 | Shearer et al. | |
| 6,946,754 | B2 | 9/2005 | Inagaki et al. | |
| 6,960,893 | B2 | 11/2005 | Yoshida et al. | |
| 7,020,595 | B1 | 3/2006 | Adibhatla et al. | |
| 7,187,152 | B1 | 3/2007 | Tsai | |
| 7,439,692 | B2 | 10/2008 | Lee | |
| 7,453,229 | B2 | 11/2008 | Lee et al. | |
| 7,456,592 | B2 | 11/2008 | Yoo et al. | |
| 7,497,146 | B2 | 3/2009 | Clausin | |
| 7,550,941 | B2 | 6/2009 | Dainez et al. | |
| 7,614,856 | B2 | 11/2009 | Inagaki et al. | |
| 7,618,243 | B2 | 11/2009 | Tian et al. | |
| 7,628,591 | B2 | 12/2009 | Yoo et al. | |
| 7,663,275 | B2 | 2/2010 | McGill et al. | |
| 8,011,183 | B2 | 9/2011 | Berchowitz | |
| 8,127,560 | B2 | 3/2012 | Dicken et al. | |
| 8,177,523 | B2 | 5/2012 | Patel et al. | |
| 8,241,015 | B2 | 8/2012 | Lillie et al. | |
| 8,749,112 | B2 | 6/2014 | Buquet et al. | |
| 8,784,069 | B2 | 7/2014 | Lilie et al. | |
| 9,470,223 | B2 | 10/2016 | Mallampalli et al. | |
| 9,518,578 | B2 | 12/2016 | Dainez et al. | |
| 9,890,778 | B2 | 2/2018 | Kusumba et al. | |
| 9,970,426 | B2 | 5/2018 | Kim et al. | |
| 2001/0005320 | A1 | 6/2001 | Ueda et al. | |
| 2002/0093327 | A1 | 7/2002 | Yoo et al. | |
| 2002/0150477 | A1 | 10/2002 | Hwang et al. | |
| 2003/0026703 | A1 | 2/2003 | Yoo et al. | |
| 2003/0044286 | A1 | 3/2003 | Kim | |
| 2003/0099550 | A1 | 5/2003 | Kim | |
| 2003/0108430 | A1 | 6/2003 | Yoshida et al. | |
| 2003/0147759 | A1 | 8/2003 | Chang | |
| 2003/0161734 | A1 | 8/2003 | Kim | |
| 2003/0177773 | A1 | 9/2003 | Kim | |
| 2003/0201745 | A1 | 10/2003 | Hayashi | |
| 2004/0005222 | A1 | 1/2004 | Yoshida et al. | |
| 2004/0066163 | A1 | 4/2004 | Yoo et al. | |
| 2004/0067140 | A1 | 4/2004 | Yoo et al. | |
| 2004/0071556 | A1 | 4/2004 | Sung et al. | |
| 2004/0108824 | A1 | 6/2004 | Ueda et al. | |
| 2004/0119434 | A1 | 6/2004 | Dadd | |
| 2004/0169480 | A1 | 9/2004 | Ueda et al. | |
| 2004/0189103 | A1 | 9/2004 | Duncan et al. | |
| 2004/0236494 | A1 | 11/2004 | DeBotton et al. | |
| 2005/0031470 | A1 | 2/2005 | Lee | |
| 2005/0083196 | A1 * | 4/2005 | Furem | E02F 9/205 340/539.16 |
| 2005/0111987 | A1 | 5/2005 | Yoo et al. | |
| 2005/0137722 | A1 | 6/2005 | Yoo et al. | |
| 2005/0141998 | A1 | 6/2005 | Yoo et al. | |
| 2005/0168179 | A1 | 8/2005 | McGill et al. | |
| 2006/0070518 | A1 | 4/2006 | McGill et al. | |
| 2006/0110259 | A1 | 5/2006 | Puff et al. | |
| 2006/0171814 | A1 | 8/2006 | Dainez et al. | |
| 2006/0171822 | A1 | 8/2006 | Seagar et al. | |
| 2006/0228221 | A1 | 10/2006 | Heo | |
| 2006/0228224 | A1 | 10/2006 | Hong et al. | |
| 2006/0251524 | A1 | 11/2006 | Yoo et al. | |
| 2006/0257264 | A1 | 11/2006 | Kim et al. | |
| 2007/0095073 | A1 | 5/2007 | Tian et al. | |
| 2007/0159128 | A1 | 7/2007 | Dainez et al. | |
| 2007/0196214 | A1 | 8/2007 | Bocchiola | |
| 2007/0241697 | A1 | 10/2007 | Sung et al. | |
| 2007/0241698 | A1 | 10/2007 | Sung et al. | |
| 2007/0276544 | A1 | 11/2007 | Dainez et al. | |
| 2008/0294098 | A1 | 11/2008 | Sarkinen et al. | |
| 2009/0004026 | A1 | 1/2009 | Yoo et al. | |
| 2009/0010766 | A1 | 1/2009 | Yoo et al. | |
| 2009/0039655 | A1 | 2/2009 | Berchowitz | |
| 2009/0047138 | A1 | 2/2009 | Yoo et al. | |
| 2009/0094977 | A1 | 4/2009 | Hill | |
| 2009/0097987 | A1 | 4/2009 | Sung et al. | |
| 2009/0263262 | A1 | 10/2009 | McGill | |
| 2010/0047079 | A1 | 2/2010 | Reinschke | |
| 2011/0056196 | A1 | 3/2011 | Berchowitz et al. | |
| 2011/0056235 | A1 | 3/2011 | Hoshino et al. | |
| 2011/0058960 | A1 | 3/2011 | Bernhard Lilie et al. | |
| 2011/0103973 | A1 * | 5/2011 | Dainez | F04B 35/045 417/44.1 |
| 2012/0177513 | A1 | 7/2012 | Lilie et al. | |
| 2012/0257993 | A1 | 10/2012 | Ono et al. | |
| 2013/0034456 | A1 | 2/2013 | Schoegler | |
| 2013/0189119 | A1 | 7/2013 | Dainez et al. | |
| 2013/0243607 | A1 | 9/2013 | Dainez et al. | |
| 2014/0072461 | A1 | 3/2014 | Barito et al. | |
| 2014/0186194 | A1 | 7/2014 | Dainez et al. | |
| 2014/0234137 | A1 | 8/2014 | Roman et al. | |
| 2014/0333236 | A1 | 11/2014 | Yamanaka et al. | |
| 2015/0125323 | A1 | 5/2015 | Stair et al. | |
| 2015/0226195 | A1 * | 8/2015 | Mallampalli | F04B 35/045 417/44.1 |
| 2016/0215767 | A1 * | 7/2016 | Kusumba | F04B 35/04 |
| 2016/0215770 | A1 * | 7/2016 | Kusumba | F04B 49/065 |
| 2016/0215772 | A1 * | 7/2016 | Kusumba | F04B 35/045 |
| 2016/0305420 | A1 | 10/2016 | Adler et al. | |
| 2017/0009762 | A1 | 1/2017 | Lilie et al. | |
| 2017/0122305 | A1 * | 5/2017 | Kusumba | F04B 49/06 |
| 2017/0122309 | A1 * | 5/2017 | Kusumba | F04B 51/00 |

FOREIGN PATENT DOCUMENTS

| | | |
|---|---|---|
| JP | H09287558 | 11/1997 |
| JP | 2003315205 A | 11/2003 |
| JP | 3762469 B2 | 4/2006 |
| WO | WO 0079671 A1 | 12/2000 |
| WO | WO 2005/028841 | 3/2005 |
| WO | WO 2006/013377 | 2/2006 |
| WO | WO 2006/081642 | 8/2006 |
| WO | WO 2013/003923 | 1/2013 |

OTHER PUBLICATIONS

Bidikli, A New Robust Integral of Sign Error Feedback Controller with Adaptive Compensation Gain, Dec. 2013, Applicant submitted NPL (Year: 2013).*

Mantri, Development and Validation of Integrated Design Framework for Compressor System Model, 2014, Applicant submitted NPL (Year: 2014).*

Chen, Accurate Motion Control of Linear Motors with Adaptive Robust Compensation of Nonlinear Electromagnetic Field Effect, 2011, Applicant submitted NPL (Year: 2011).*

(56) References Cited

OTHER PUBLICATIONS

Bidikli et al., A New Robust 'Integral of Sign of Error' Feedback Controller with Adaptive Compensation Gain, 52nd IEEE Conference on Decision and Control, Dec. 10-13, 2013, Florence, Italy, pp. 3782-3787.
Chen et al., Accurate Motion Control of Linear Motors with Adaptive Robust Compensation of Nonlinear Electromagnetic Field Effect, (Proceedings of the ASME 2011 Dynamic Systems and Control Conference, DSCC 2011, Oct. 31-Nov. 2, 2011, Arlington, VA, USA, DSCC2011-5991), 8 pages.
Chiang et al., Innovative Linear Compressor by Magnetic Drive and Control, (Proceedings of 2011 International Conference on Modelling, Identification and Control, Shanghai, China, Jun. 26-29, 2011), pp. 300-305.
Mantri et al., Development and Validation of Integrated Design Framework for Compressor System Model, Purdue University / Purdue e-Pubs, International Compressor Engineering Conference, School of Mechanical Engineering, 2014 (10 pages).
Mehta et al., Principles of Electrical Engineering and Electronics, Jan. 1, 2006, S. Chand & Company Ltd., 2nd Ed., pp. 275-277.
Smith, The Scientist and Engineer's Guide to Digital Signal Processing, Second Edition, published 1999, 22 pages.
Xian et al., A Continuous Asymptotic Tracking Control Strategy for Uncertain Nonlinear Systems, IEEE Transactions on Automatic Control, vol. 49, No. 7, Jul. 2004, pp. 1206-1211.
Beck, Wesley, Pump Handbook (2007) McGraw-Hill, $4^{th}$ Edition, Chapter 16 Pump Testing (Year: 2007), pp. 16.1-16.42.

* cited by examiner

METHOD FOR OPERATING A LINEAR COMPRESSOR

FIELD OF THE INVENTION

The present subject matter relates generally to linear compressors, such as linear compressors for refrigerator appliances.

BACKGROUND OF THE INVENTION

Certain refrigerator appliances include sealed systems for cooling chilled chambers of the refrigerator appliances. The sealed systems generally include a compressor that generates compressed refrigerant during operation of the sealed systems. The compressed refrigerant flows to an evaporator where heat exchange between the chilled chambers and the refrigerant cools the chilled chambers and food items located therein.

Recently, certain refrigerator appliances have included linear compressors for compressing refrigerant. Linear compressors generally include a piston and a driving coil. A voltage excitation induces a current within the driving coil that generates a force for sliding the piston forward and backward within a chamber. During motion of the piston within the chamber, the piston compresses refrigerant. Motion of the piston within the chamber is generally controlled such that the piston does not crash against another component of the linear compressor during motion of the piston within the chamber. Such head crashing can damage various components of the linear compressor, such as the piston or an associated cylinder. While head crashing is preferably avoided, it can be difficult to accurately control a motor of the linear compressor to avoid head crashing.

Accordingly, a method for operating a linear compressor with features for avoiding head crashing would be useful. In particular, a method for operating a linear compressor with features for avoiding head crashing without utilizing a position sensor would be useful.

BRIEF DESCRIPTION OF THE INVENTION

The present subject matter provides a method for operating a linear compressor. The method includes establishing a set of predictors, and establishing a model for an estimated head clearance of the linear compressor with the set of predictors. Coefficients of the model for the estimated head clearance of the linear compressor may also be established. Additional aspects and advantages of the invention will be set forth in part in the following description, or may be apparent from the description, or may be learned through practice of the invention.

In a first exemplary embodiment, a method for operating a linear compressor is provided. The method includes supplying a motor of the linear compressor with a time varying voltage having a peak motor voltage and an excitation frequency, measuring a peak motor current of the linear compressor while the time varying voltage is supplied to the motor of the linear compressor, and calculating an observed minimum velocity of the motor of the linear compressor and an observed stroke length of the motor of the linear compressor using an electrical dynamic model for the motor of the linear compressor and a robust integral of the sign of the error feedback. A set of predictors include the peak motor voltage, the excitation frequency, the peak motor current, the observed minimum velocity and the observed stroke length. The method also includes removing redundant predictors from the set of predictors in order to establish a reduced set of predictors, establishing a model for an estimated head clearance of the linear compressor with the reduced set of predictors, and establishing coefficients of the model for the estimated head clearance of the linear compressor.

In a second exemplary embodiment, a method for operating a linear compressor is provided. The method includes supplying a motor of the linear compressor with a time varying voltage having a peak motor voltage and an excitation frequency, measuring a peak motor current of the linear compressor while the time varying voltage is supplied to the motor of the linear compressor, calculating an observed minimum velocity of the motor of the linear compressor and an observed stroke length of the motor of the linear compressor, and establishing a set of predictors. The set of predictors includes the peak motor voltage, the excitation frequency, the peak motor current, the observed minimum velocity, the observed stroke length, a product of the peak motor voltage and the excitation frequency, a product of the peak motor voltage and the observed stroke length, and a product of the excitation frequency and the observed minimum velocity. The method also includes establishing a model for an estimated head clearance of the linear compressor by conducting a best subsets regression with the set of predictors and establishing coefficients of the model for the estimated head clearance of the linear compressor.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
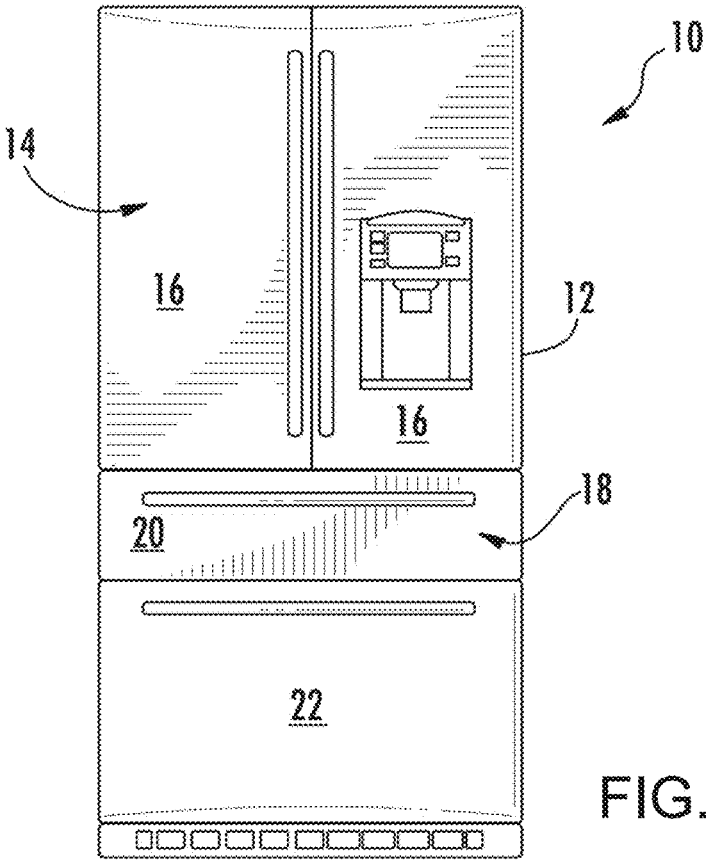
FIG. 1 is a front elevation view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
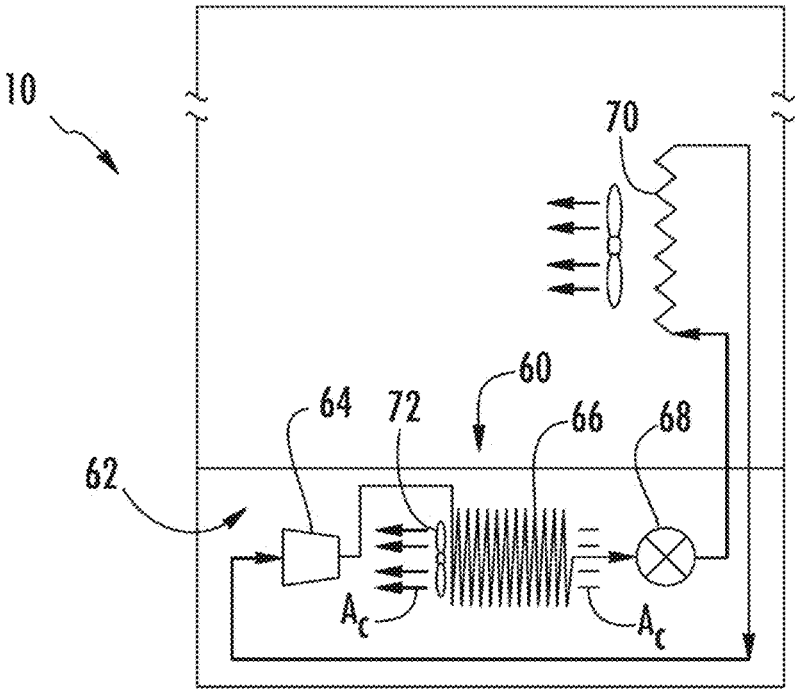
FIG. 2 is schematic view of certain components of the exemplary refrigerator appliance of FIG. 1.

FIG. 1 depicts a refrigerator appliance 10 that incorporates a sealed refrigeration system 60 (FIG. 2). It should be appreciated that the term "refrigerator appliance" is used in a generic sense herein to encompass any manner of refrigeration appliance, such as a freezer, refrigerator/freezer combination, and any style or model of conventional refrigerator. In addition, it should be understood that the present subject matter is not limited to use in appliances. Thus, the present subject matter may be used for any other suitable purpose, such as vapor compression within air conditioning units or air compression within air compressors.

In the illustrated exemplary embodiment shown in FIG. 1, the refrigerator appliance 10 is depicted as an upright refrigerator having a cabinet or casing 12 that defines a number of internal chilled storage compartments. In particular, refrigerator appliance 10 includes upper fresh-food compartments 14 having doors 16 and lower freezer compartment 18 having upper drawer 20 and lower drawer 22. The drawers 20 and 22 are "pull-out" drawers in that they can be manually moved into and out of the freezer compartment 18 on suitable slide mechanisms.

FIG. 2 is a schematic view of certain components of refrigerator appliance 10, including a sealed refrigeration system 60 of refrigerator appliance 10. A machinery compartment 62 contains components for executing a known vapor compression cycle for cooling air. The components include a compressor 64, a condenser 66, an expansion device 68, and an evaporator 70 connected in series and charged with a refrigerant. As will be understood by those skilled in the art, refrigeration system 60 may include additional components, e.g., at least one additional evaporator, compressor, expansion device, and/or condenser. As an example, refrigeration system 60 may include two evaporators.

Within refrigeration system 60, refrigerant flows into compressor 64, which operates to increase the pressure of the refrigerant. This compression of the refrigerant raises its temperature, which is lowered by passing the refrigerant through condenser 66. Within condenser 66, heat exchange with ambient air takes place so as to cool the refrigerant. A fan 72 is used to pull air across condenser 66, as illustrated by arrows $A_C$, so as to provide forced convection for a more rapid and efficient heat exchange between the refrigerant within condenser 66 and the ambient air. Thus, as will be understood by those skilled in the art, increasing air flow across condenser 66 can, e.g., increase the efficiency of condenser 66 by improving cooling of the refrigerant contained therein.

An expansion device (e.g., a valve, capillary tube, or other restriction device) 68 receives refrigerant from condenser 66. From expansion device 68, the refrigerant enters evaporator 70. Upon exiting expansion device 68 and entering evaporator 70, the refrigerant drops in pressure. Due to the pressure drop and/or phase change of the refrigerant, evaporator 70 is cool relative to compartments 14 and 18 of refrigerator appliance 10. As such, cooled air is produced and refrigerates compartments 14 and 18 of refrigerator appliance 10. Thus, evaporator 70 is a type of heat exchanger which transfers heat from air passing over evaporator 70 to refrigerant flowing through evaporator 70.

Collectively, the vapor compression cycle components in a refrigeration circuit, associated fans, and associated compartments are sometimes referred to as a sealed refrigeration system operable to force cold air through compartments 14, 18 (FIG. 1). The refrigeration system 60 depicted in FIG. 2 is provided by way of example only. Thus, it is within the scope of the present subject matter for other configurations of the refrigeration system to be used as well.

Figure 3:
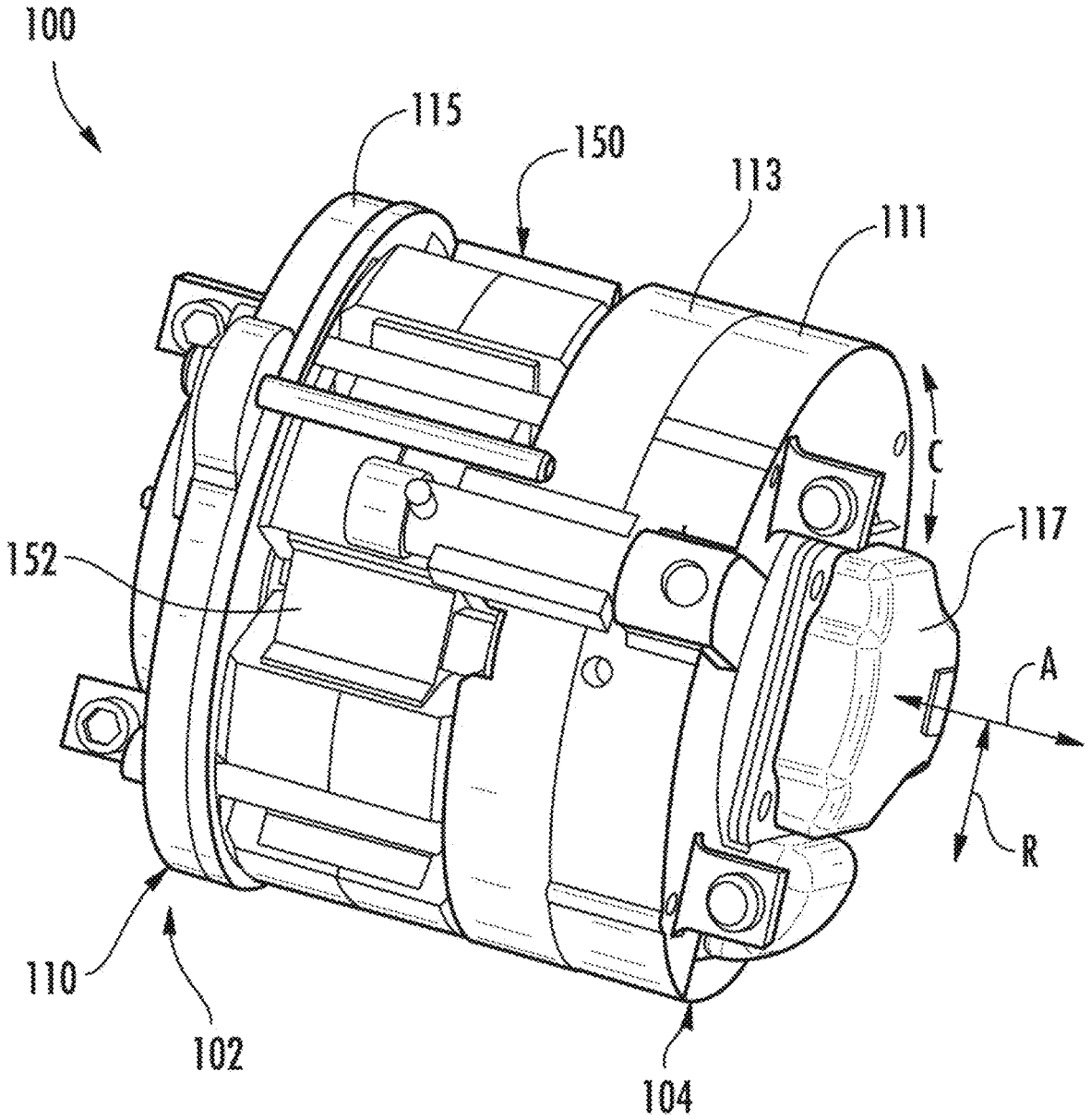
FIG. 3 provides a perspective view of a linear compressor according to an exemplary embodiment of the present subject matter.
Figure 4:
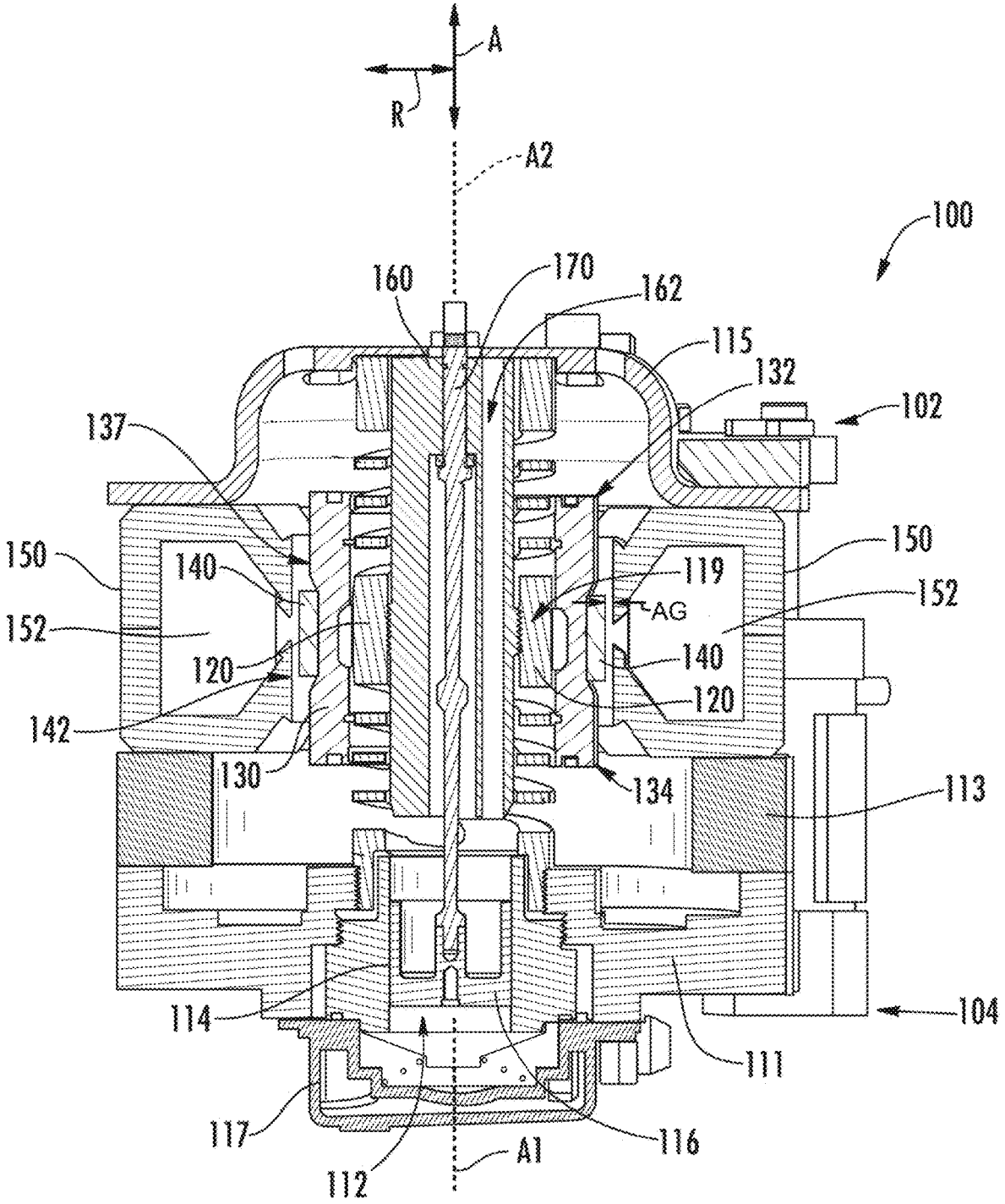
FIG. 4 provides a side section view of the exemplary linear compressor of FIG. 3.
Figure 5:
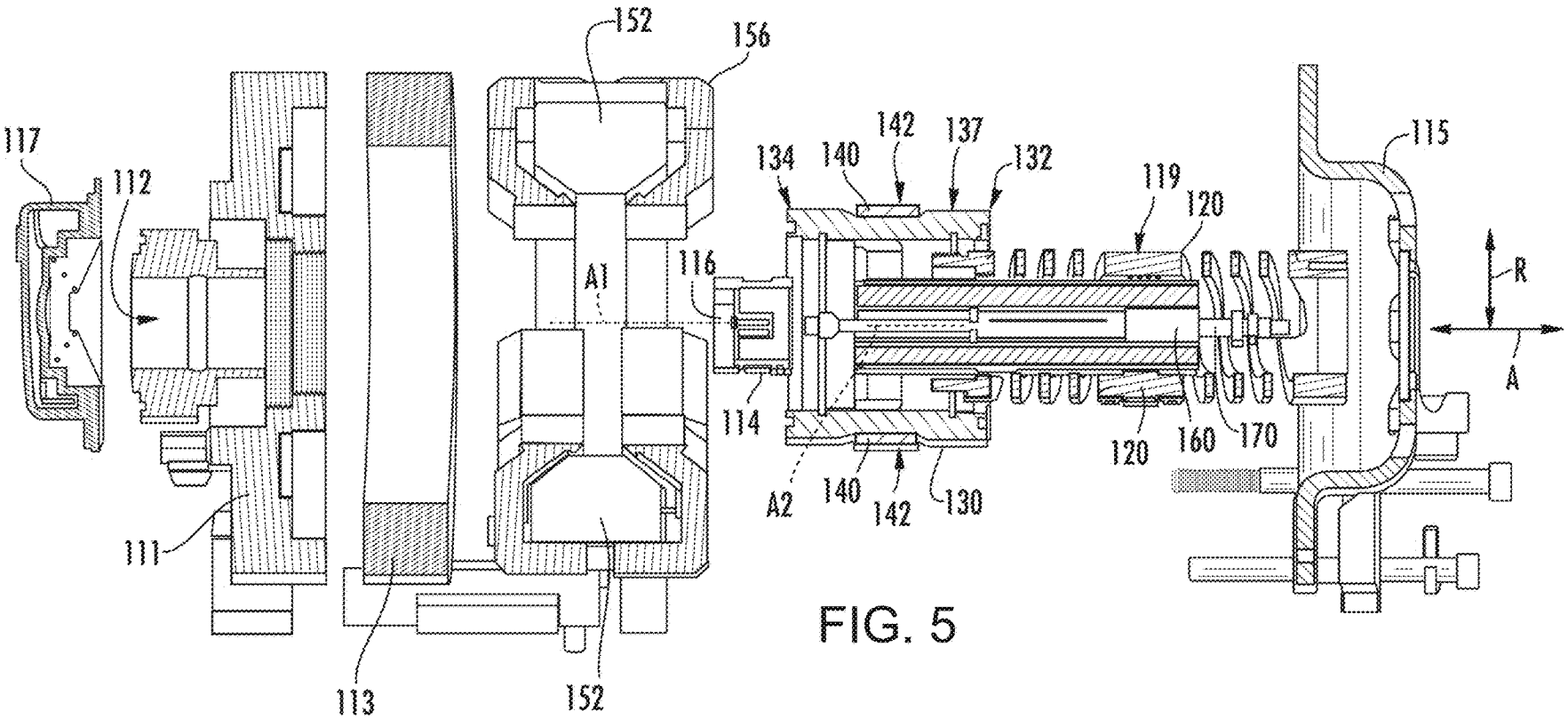
FIG. 5 provides an exploded view of the exemplary linear compressor of FIG. 4.

FIG. 3 provides a perspective view of a linear compressor 100 according to an exemplary embodiment of the present subject matter. FIG. 4 provides a side section view of linear compressor 100. FIG. 5 provides an exploded side section view of linear compressor 100. As discussed in greater detail below, linear compressor 100 is operable to increase a pressure of fluid within a chamber 112 of linear compressor 100. Linear compressor 100 may be used to compress any suitable fluid, such as refrigerant or air. In particular, linear compressor 100 may be used in a refrigerator appliance, such as refrigerator appliance 10 (FIG. 1) in which linear compressor 100 may be used as compressor 64 (FIG. 2). As may be seen in FIG. 3, linear compressor 100 defines an axial direction A, a radial direction R and a circumferential direction C. Linear compressor 100 may be enclosed within a hermetic or air-tight shell (not shown). The hermetic shell can, e.g., hinder or prevent refrigerant from leaking or escaping from refrigeration system 60.

Turning now to FIG. 4, linear compressor 100 includes a casing 110 that extends between a first end portion 102 and a second end portion 104, e.g., along the axial direction A. Casing 110 includes various static or non-moving structural components of linear compressor 100. In particular, casing 110 includes a cylinder assembly 111 that defines a chamber 112. Cylinder assembly 111 is positioned at or adjacent second end portion 104 of casing 110. Chamber 112 extends longitudinally along the axial direction A. Casing 110 also includes a motor mount mid-section 113 and an end cap 115 positioned opposite each other about a motor. A stator, e.g., including an outer back iron 150 and a driving coil 152, of the motor is mounted or secured to casing 110, e.g., such that the stator is sandwiched between motor mount mid-section 113 and end cap 115 of casing 110. Linear compressor 100 also includes valves (such as a discharge valve assembly 117 at an end of chamber 112) that permit refrigerant to enter and exit chamber 112 during operation of linear compressor 100.

A piston assembly 114 with a piston head 116 is slidably received within chamber 112 of cylinder assembly 111. In particular, piston assembly 114 is slidable along a first axis A1 within chamber 112. The first axis A1 may be substantially parallel to the axial direction A. During sliding of piston head 116 within chamber 112, piston head 116 compresses refrigerant within chamber 112. As an example, from a top dead center position, piston head 116 can slide within chamber 112 towards a bottom dead center position along the axial direction A, i.e., an expansion stroke of piston head 116. When piston head 116 reaches the bottom dead center position, piston head 116 changes directions and slides in chamber 112 back towards the top dead center position, i.e., a compression stroke of piston head 116. It should be understood that linear compressor 100 may include an additional piston head and/or additional chamber at an opposite end of linear compressor 100. Thus, linear compressor 100 may have multiple piston heads in alternative exemplary embodiments.

Linear compressor 100 also includes an inner back iron assembly 130. Inner back iron assembly 130 is positioned in the stator of the motor. In particular, outer back iron 150 and/or driving coil 152 may extend about inner back iron assembly 130, e.g., along the circumferential direction C. Inner back iron assembly 130 extends between a first end portion 132 and a second end portion 134, e.g., along the axial direction A.

Inner back iron assembly 130 also has an outer surface 137. At least one driving magnet 140 is mounted to inner back iron assembly 130, e.g., at outer surface 137 of inner back iron assembly 130. Driving magnet 140 may face and/or be exposed to driving coil 152. In particular, driving magnet 140 may be spaced apart from driving coil 152, e.g., along the radial direction R by an air gap AG. Thus, the air gap AG may be defined between opposing surfaces of driving magnet 140 and driving coil 152. Driving magnet 140 may also be mounted or fixed to inner back iron assembly 130 such that an outer surface 142 of driving magnet 140 is substantially flush with outer surface 137 of inner back iron assembly 130. Thus, driving magnet 140 may be inset within inner back iron assembly 130. In such a manner, the magnetic field from driving coil 152 may have to pass through only a single air gap (e.g., air gap AG) between outer back iron 150 and inner back iron assembly 130 during operation of linear compressor 100, and linear compressor 100 may be more efficient than linear compressors with air gaps on both sides of a driving magnet.

As may be seen in FIG. 4, driving coil 152 extends about inner back iron assembly 130, e.g., along the circumferential direction C. Driving coil 152 is operable to move the inner back iron assembly 130 along a second axis A2 during operation of driving coil 152. The second axis may be substantially parallel to the axial direction A and/or the first axis A1. As an example, driving coil 152 may receive a current from a current source (not shown) in order to generate a magnetic field that engages driving magnet 140 and urges piston assembly 114 to move along the axial direction A in order to compress refrigerant within chamber 112 as described above and will be understood by those skilled in the art. In particular, the magnetic field of driving coil 152 may engage driving magnet 140 in order to move inner back iron assembly 130 along the second axis A2 and piston head 116 along the first axis A1 during operation of driving coil 152. Thus, driving coil 152 may slide piston assembly 114 between the top dead center position and the bottom dead center position, e.g., by moving inner back iron assembly 130 along the second axis A2, during operation of driving coil 152.

A piston flex mount 160 is mounted to and extends through inner back iron assembly 130. A coupling 170 extends between piston flex mount 160 and piston assembly 114, e.g., along the axial direction A. Thus, coupling 170 connects inner back iron assembly 130 and piston assembly 114 such that motion of inner back iron assembly 130, e.g., along the axial direction A or the second axis A2, is transferred to piston assembly 114. Piston flex mount 160 defines an input passage 162 that permits refrigerant to flow therethrough.

Linear compressor 100 may include various components for permitting and/or regulating operation of linear compressor 100. In particular, linear compressor 100 includes a controller (not shown) that is configured for regulating operation of linear compressor 100. The controller is in, e.g., operative, communication with the motor, e.g., driving coil 152 of the motor. Thus, the controller may selectively activate driving coil 152, e.g., by supplying voltage to driving coil 152, in order to compress refrigerant with piston assembly 114 as described above.

The controller includes memory and one or more processing devices such as microprocessors, CPUs or the like, such as general or special purpose microprocessors operable to execute programming instructions or micro-control code associated with operation of linear compressor 100. The memory can represent random access memory such as DRAM, or read only memory such as ROM or FLASH. The processor executes programming instructions stored in the memory. The memory can be a separate component from the processor or can be included onboard within the processor. Alternatively, the controller may be constructed without using a microprocessor, e.g., using a combination of discrete analog and/or digital logic circuitry (such as switches, amplifiers, integrators, comparators, flip-flops, AND gates, field programmable gate arrays (FPGA), and the like) to perform control functionality instead of relying upon software.

Linear compressor 100 also includes a spring assembly 120. Spring assembly 120 is positioned in inner back iron assembly 130. In particular, inner back iron assembly 130 may extend about spring assembly 120, e.g., along the circumferential direction C. Spring assembly 120 also extends between first and second end portions 102 and 104 of casing 110, e.g., along the axial direction A. Spring assembly 120 assists with coupling inner back iron assembly 130 to casing 110, e.g., cylinder assembly 111 of casing 110. In particular, inner back iron assembly 130 is fixed to spring assembly 120 at a middle portion 119 of spring assembly 120.

During operation of driving coil 152, spring assembly 120 supports inner back iron assembly 130. In particular, inner back iron assembly 130 is suspended by spring assembly 120 within the stator or the motor of linear compressor 100 such that motion of inner back iron assembly 130 along the radial direction R is hindered or limited while motion along the second axis A2 is relatively unimpeded. Thus, spring assembly 120 may be substantially stiffer along the radial direction R than along the axial direction A. In such a manner, spring assembly 120 can assist with maintaining a uniformity of the air gap AG between driving magnet 140 and driving coil 152, e.g., along the radial direction R, during operation of the motor and movement of inner back iron assembly 130 on the second axis A2. Spring assembly 120 can also assist with hindering side pull forces of the motor from transmitting to piston assembly 114 and being reacted in cylinder assembly 111 as a friction loss.

The various mechanical and electrical parameters or constants of linear compressor 100 may be established or determined in any suitable manner. For example, the various mechanical and electrical parameters or constants of linear compressor 100 may be established or determined using the methodology described in U.S. Patent Publication No. 2016/0215772, which is hereby incorporated by reference in its entirety. For example, the methodology described in U.S. Patent Publication No. 2016/0215772 may be used to determine or establish a spring constant of spring assembly 120, a motor force constant of the motor of linear compressor 100, a damping coefficient of linear compressor 100, a resistance of the motor of linear compressor 100, an inductance of the motor of linear compressor 100, a moving mass (such as mass of piston assembly 114 and inner back iron assembly 130) of linear compressor 100, etc. Knowledge of such mechanical and electrical parameters or constants of linear compressor 100 may improve performance or operation of linear compressor 100. In alternative exemplary embodiments, a manufacturer of linear compressor 100 may provide nominal values for the various mechanical and electrical parameters or constants of linear compressor 100. The various mechanical and electrical parameters or constants of linear compressor 100 may also be measured or estimated using any other suitable method or mechanism.

Figure 6:
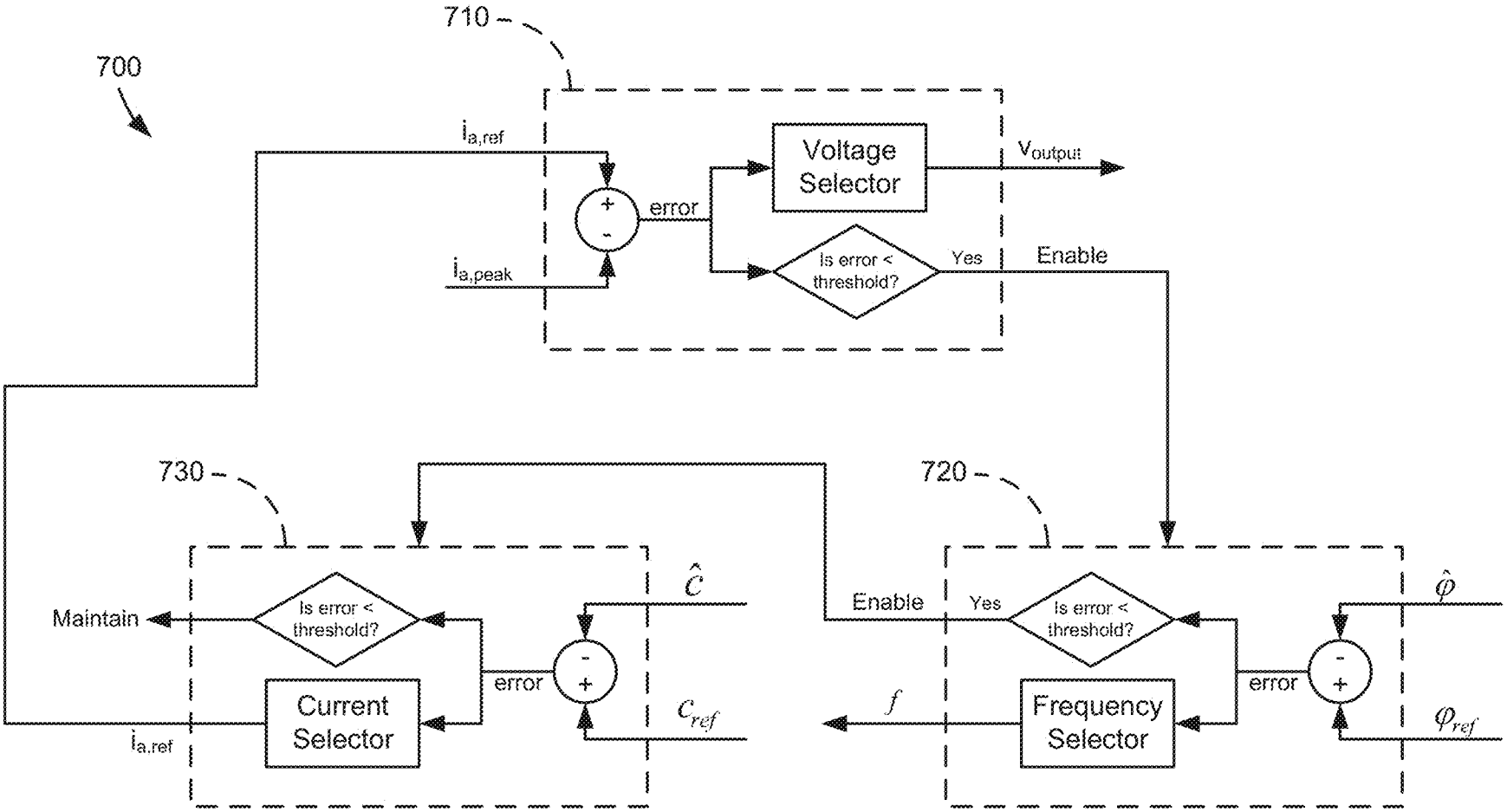
FIG. 6 illustrates a method for operating a linear compressor according to another exemplary embodiment of the present subject matter.

FIG. 6 illustrates a method 700 for operating a linear compressor according to another exemplary embodiment of the present subject matter. Method 700 may be used to operate any suitable linear compressor. For example, method 700 may be used to operate linear compressor 100 (FIG. 3). The controller of method 700 may be programmed or configured to implement method 700. Thus, method 700 is discussed in greater detail below with reference to linear compressor 100. Utilizing method 700, the motor of linear compressor 100 may be operating according to various control methods.

As may be seen in FIG. 6, method 700 includes providing a current controller 710, a resonance controller 720 and a clearance controller 730. Method 700 selectively operates linear compressor with one of current controller 710, resonance controller 720 and clearance controller 730. Thus, at least one of current controller 710, resonance controller 720 and clearance controller 730 selects or adjusts operational parameters of the motor of linear compressor 100, e.g., in order to efficiently reciprocate piston assembly 114 and compress fluid within chamber 112. Switching between current controller 710, resonance controller 720 and clearance controller 730 may improve performance or operation of linear compressor 100, as discussed in greater detail below.

Current controller 710 may be the primary control for operation of linear compressor 100 during method 700. Current controller 710 is configured for adjusting the supply voltage $v_{output}$ to linear compressor 100. For example, current controller 710 may be configured to adjust a peak voltage or amplitude of the supply voltage $v_{output}$ to linear compressor 100. Current controller 710 may adjust the supply voltage $v_{output}$ in order to reduce a difference or error between a peak current, $i_{a,peak}$, supplied to linear compressor 100 and a reference peak current $i_{a,ref}$. The peak current $i_{a,peak}$ may be measured or estimated utilizing any suitable method or mechanism. For example, an ammeter may be used to measure the peak current $i_{a,peak}$. The voltage selector of current controller 710 may operate as a proportional-integral (PI) controller in order to reduce the error between the peak current $i_{a,peak}$ and the reference peak current $i_{a,ref}$. At a start of method 700, the reference peak current $i_{a,ref}$ may be a default value, and clearance controller 730 may adjust (e.g., increase or decrease) the reference peak current $i_{a,ref}$ during subsequent steps of method 700, as discussed in greater detail below, such that method 700 reverts to current controller 710 in order to adjust the amplitude of the supply voltage $v_{output}$ and reduce the error between the peak current $i_{a,peak}$ supplied to linear compressor 100 and the adjusted reference peak current $i_{a,ref}$ from clearance controller 730.

Figure 7:
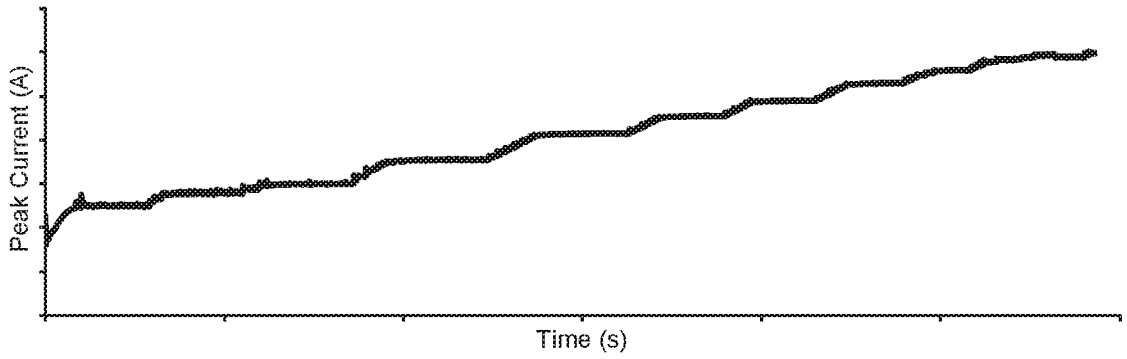
FIGS. 7, 8 and 9 illustrate exemplary plots of various operating conditions of the linear compressor during the method of FIG. 6.
Figure 8:
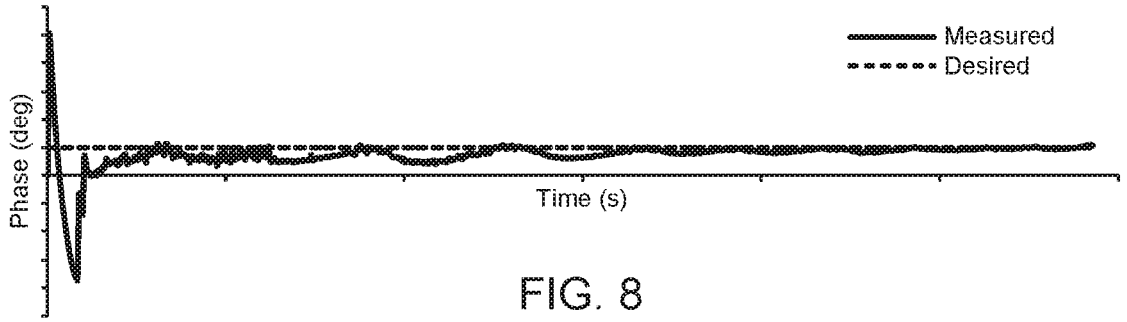
Figure 9:
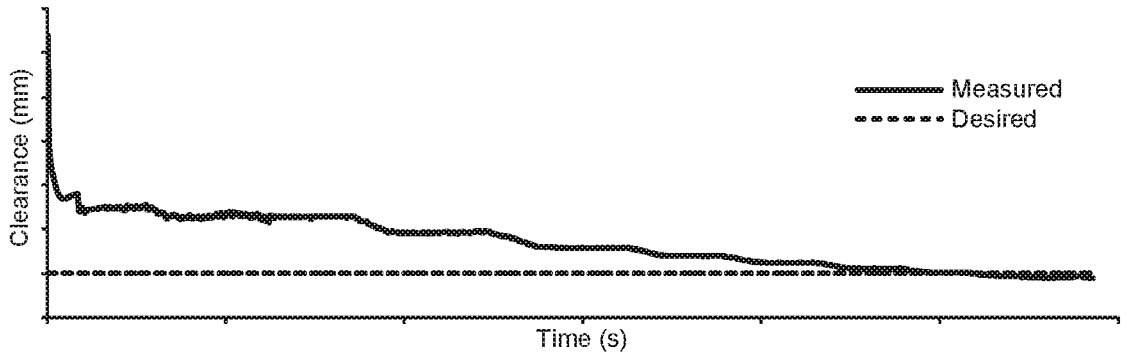

As shown in FIG. 6, current controller 710 continues to determine or regulate the amplitude of the supply voltage $v_{output}$ when the error between the peak current $i_{a,peak}$ and the reference peak current $i_{a,ref}$ is greater than (e.g., or outside) a threshold current error. Conversely, current controller 710 passes off determining or regulating the supply voltage $v_{output}$ to resonance controller 720 when the error between the peak current $i_{a,peak}$ and the reference peak current $i_{a,ref}$ is less than (e.g., or within) the threshold current error. Thus, when the current induced in the motor of linear compressor 100 settles, method 700 passes control of the supply voltage $v_{output}$ from current controller 710 to resonance controller 720, e.g., as shown in FIGS. 7 and 8. However, it should be understood that current controller 710 may be always activated or running during method 700, e.g., such that current controller 710 is always determining or regulating the supply voltage $v_{output}$ to ensure that the error between the peak current $i_{a,peak}$ and the reference peak current $i_{a,ref}$ is greater than (e.g., or outside) the threshold current error.

Resonance controller 720 is configured for adjusting the supply voltage $v_{output}$. For example, when activated or enabled, resonance controller 720 may adjust the phase or frequency of the supply voltage $v_{output}$ in order to reduce a phase difference or error between a reference phase, $\varphi_{ref}$, and a phase between (e.g., zero crossings of) an observed velocity, $\hat{v}$ or $\dot{\hat{x}}$, of the motor linear compressor 100 and a current, $i_a$, induced in the motor of linear compressor 100. The reference phase $\varphi_{ref}$ may be any suitable phase. For example, the reference phase $\varphi_{ref}$ may be ten degrees. As another example, the reference phase $\varphi_{ref}$ may be one degree. Thus, resonance controller 720 may operate to regulate the supply voltage $v_{output}$ in order to drive the motor linear compressor 100 at about a resonant frequency. As used herein, the term "about" means within five degrees of the stated phase when used in the context of phases.

For the resonance controller 720, the current $i_a$ induced in the motor of linear compressor 100 may be measured or estimated utilizing any suitable method or mechanism. For example, an ammeter may be used to measure the current $i_a$. The observed velocity of the motor linear compressor 100 may be estimated or observed utilizing an electrical dynamic model for the motor of linear compressor 100. Any suitable electrical dynamic model for the motor of linear compressor 100 may be utilized. For example, the electrical dynamic model for the motor of linear compressor 100 described in U.S. Patent Publication No. 2016/0215772 for step 610 of method 600 may be used. The electrical dynamic model for the motor of linear compressor 100 may also be modified such that $$\frac{di}{dt} = \frac{v_a}{L_i} - \frac{r_i i}{L_i} - f$$

$$\text{where } f = \frac{\alpha}{L_i}\dot{x}.$$

A back-EMF of the motor of linear compressor 100 may be estimated using at least the electrical dynamic model for the motor of linear compressor 100 and a robust integral of the sign of the error feedback. As an example, the back-EMF the motor of linear compressor 100 may be estimated by solving $$\hat{f} = (K_1+1)e(t) + \int_{t_0}^{t}[(K_1+1)e(\sigma) + K_2\,\mathrm{sgn}(e(\sigma))]d\sigma - (K_1+1)e(t_0)$$

where $\hat{f}$ is an estimated back-EMF of the motor of linear compressor 100;

$K_1$ and $K_2$ are real, positive gains; and $e = \hat{i}$ and $\dot{e} = f - \hat{f}$; and $\mathrm{sgn}(\cdot)$ is the signum or sign function.

In turn, the observed velocity $\dot{\hat{x}}$ of the motor of linear compressor 100 may be estimated based at least in part on the back-EMF of the motor. For example, the observed velocity of the motor of linear compressor 100 may be determined by solving $$\hat{\dot{x}} = \frac{L_i}{\alpha}\hat{f}$$

where $\hat{\dot{x}}$ is the estimated or observed velocity $\dot{x}$ of the motor of linear compressor 100;

$\alpha$ is a motor force constant; and $L_i$ is an inductance of the motor of linear compressor 100. The motor force constant and the inductance of the motor of linear compressor 100 may be estimated with method 600, as described above.

As shown in FIG. 6, resonance controller 720 continues to determine or regulate the frequency of the supply voltage $v_{output}$ when the error between the reference phase $\varphi_{ref}$ and the phase between the observed velocity $\dot{x}$ and the current $i_a$ is greater than (e.g., or outside) a threshold phase error. Conversely, resonance controller 720 passes off determining or regulating the supply voltage $v_{output}$ to clearance controller 730 when the error between the reference phase $\varphi_{ref}$ and the phase between the observed velocity $\dot{x}$ and the current $i_a$ is less than (e.g., or within) the threshold phase error. Thus, when the motor linear compressor 100 is operating at about a resonant frequency, method 700 passes control of the supply voltage $v_{output}$ from resonance controller 720 to clearance controller 730, e.g., as shown in FIG. 6.

The threshold phase error may be any suitable phase. For example, the voltage selector of resonance controller 720 may utilize multiple threshold phase errors in order to more finely or accurately adjust the phase or frequency of the supply voltage $v_{output}$ to achieve a desired frequency for linear compressor 100. For example, a first threshold phase error, a second threshold phase error and a third threshold phase error may be provided and sequentially evaluated by the voltage selector of resonance controller 720 to adjust the frequency during method 700. The first phase clearance error may be about twenty degrees, and resonance controller 720 may successively adjust (e.g., increase or decrease) the frequency by about one hertz until the error between the reference phase $\varphi_{ref}$ and the phase between the observed velocity $\dot{x}$ and the current $i_a$ is less than the first threshold phase error. The second threshold phase error may be about five degrees, and resonance controller 720 may successively adjust (e.g., increase or decrease) the frequency by about a tenth of a hertz until the error between the reference phase $\varphi_{ref}$ and the phase between the observed velocity $\dot{x}$ and the current $i_a$ is less than the second threshold phase error. The third threshold phase error may be about one degree, and resonance controller 720 may successively adjust (e.g., increase or decrease) the frequency by about a hundredth of a hertz until the error between the reference phase $\varphi_{ref}$ and the phase between the observed velocity $\dot{x}$ and the current $i_a$ is less than the third threshold phase error. As used herein, the term "about" means within ten percent of the stated frequency when used in the context of frequencies.

Clearance controller 730 is configured for adjusting the reference peak current $i_{a,ref}$. For example, when activated or enabled, clearance controller 730 may adjust the reference peak current $i_{a,ref}$ in order to reduce a difference or error between an observed clearance, $\hat{c}$, of the motor of linear compressor 100 and a reference clearance, $c_{ref}$. Thus, clearance controller 730 may operate to regulate the reference peak current $i_{a,ref}$ in order to drive the motor linear compressor 100 at about a particular clearance between piston head 116 and discharge valve assembly 117. The reference clearance $c_{ref}$ may be any suitable distance. For example, the reference clearance $c_{ref}$ may be about two millimeters, about one millimeter or about a tenth of a millimeter. As used herein, the term "about" means within ten percent of the stated clearance when used in the context of clearances.

As shown in FIG. 6, clearance controller 730 continues to determine or regulate the reference peak current $i_{a,ref}$, e.g., when the error between the observed clearance $\hat{c}$ of the motor of linear compressor 100 and a reference clearance $c_{ref}$ is greater than (e.g., or outside) a threshold clearance error. Thus, clearance controller 730 operates the motor linear compressor 100 to avoid head crashing. When, the error between the observed clearance $\hat{c}$ of the motor of linear compressor 100 and the reference clearance $c_{ref}$ is less than (e.g., or inside) the threshold clearance error, method 700 may maintain linear compressor 100 at current operation conditions, e.g., such that the supply voltage $v_{output}$ is stable or regular.

The threshold clearance error may be any suitable clearance. For example, the voltage selector of clearance controller 730 may utilize multiple threshold clearance errors in order to more finely or accurately adjust the supply voltage $v_{output}$ to achieve a desired clearance. In particular, a first threshold clearance error, a second threshold clearance error and a third threshold clearance error may be provided and sequentially evaluated by the voltage selector of clearance controller 730 to adjust a magnitude of a change to the current $i_a$ during method 700. The first threshold clearance error may be about two millimeters, and clearance controller 730 may successively adjust (e.g., increase or decrease) the current $i_a$ by about twenty milliamps until the error between the observed clearance $\hat{c}$ of the motor of linear compressor 100 and the reference clearance $c_{ref}$ is less than the first threshold clearance error. The second threshold clearance error may be about one millimeter, and clearance controller 730 may successively adjust (e.g., increase or decrease) the current $i_a$ by about ten milliamps until the error between the observed clearance $\hat{c}$ of the motor of linear compressor 100 and the reference clearance $c_{ref}$ is less than the second threshold clearance error. The third threshold clearance error may be about a tenth of a millimeter, and clearance controller 730 may successively adjust (e.g., increase or decrease) the current $i_a$ by about five milliamps until the error between the observed clearance $\hat{c}$ of the motor of linear compressor 100 and the reference clearance $c_{ref}$ is less than the third threshold clearance error. As used herein, the term "about" means within ten percent of the stated current when used in the context of currents.

As discussed above, current controller 710 determines or regulates the amplitude of the supply voltage $v_{output}$ when the error between the peak current $i_{a,peak}$ and the reference peak current $i_{a,ref}$ is greater than (e.g., or outside) a threshold current error. By modifying the reference peak current $i_{a,ref}$, clearance controller 730 may force the error between the peak current $i_{a,peak}$ and the reference peak current $i_{a,ref}$ to be greater than (e.g., or outside) the threshold current error. Thus, priority may shift back to current controller 710 after clearance controller 730 adjusts the reference peak current $i_{a,ref}$, e.g., until current controller 710 again settles the current induced in the motor of linear compressor 100 as described above.

It should be understood that method 700 may be performed with the motor of linear compressor 100 sealed within a hermitic shell of linear compressor 100. Thus, method 700 may be performed without directly measuring velocities or positions of moving components of linear compressor 100. Utilizing method 700, the supply voltage $v_{output}$ may be adjusted by current controller 710, resonance controller 720 and/or clearance controller 730 in order to operate the motor of linear compressor 100 at a resonant frequency of the motor of linear compressor 100 without or limited head crashing. Thus, method 700 provides robust control of clearance and resonant tracking, e.g., without interference and run away conditions. For example, current controller 710 may be always running and tracking the peak current $i_{a,peak}$, e.g., as a PI controller, and resonant controller 720 and clearance controller 730 provide lower priority controls, with resonant controller 720 having a higher priority relative to clearance controller 730.

Figure 10:
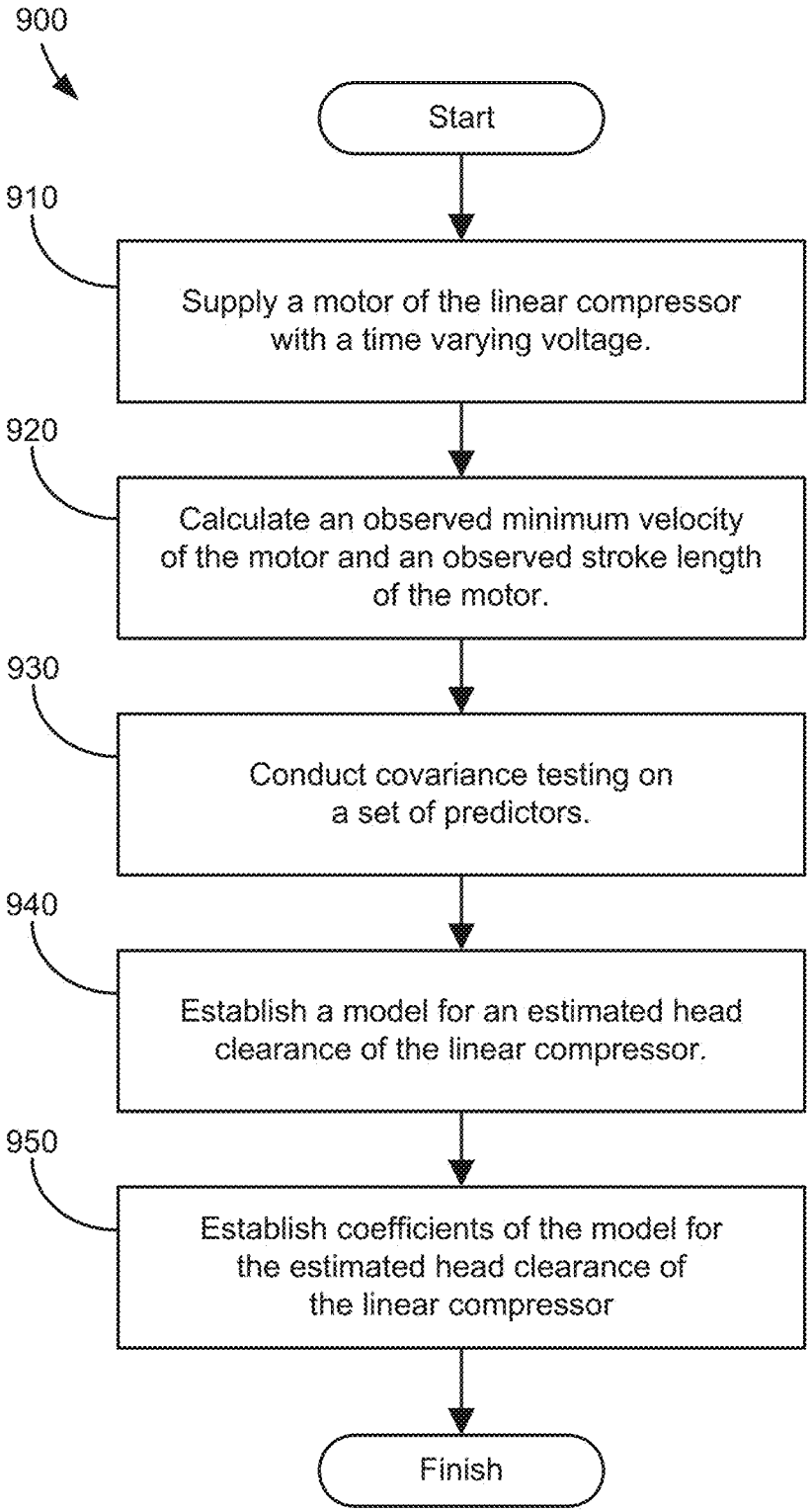
FIG. 10 illustrates a method for operating a linear compressor according to another exemplary embodiment of the present subject matter.

FIG. 10 illustrates a method 900 for operating a linear compressor according to another exemplary embodiment of the present subject matter. Method 900 may be used to operate any suitable linear compressor. For example, method 900 may be used to operate linear compressor 100 (FIG. 3). The controller of linear compressor 100 may be programmed or configured to implement method 900. Thus, method 900 is discussed in greater detail below with reference to linear compressor 100, but it will be understood that method 900 is not limited to use in or with linear compressor 100. Utilizing method 900, an estimated head clearance of linear compressor 100 may be calculated, e.g., and utilized by clearance controller 730 (FIG. 6).

At step 910, the motor (e.g., driving coil 152) of linear compressor 100 is supplied with a time varying voltage, e.g., by the controller of linear compressor 100. Any suitable time varying voltage may be supplied to the motor of linear compressor 100, and the time varying voltage at step 910 may have a peak motor voltage, $V_p$, and an excitation frequency f. A peak motor current, $i_p$, may be measured while the time varying voltage is supplied to the motor of linear compressor 100. An ammeter or any other suitable method or mechanism may be used to measure the peak motor current $i_p$.

At 920, an observed minimum velocity $\dot{x}_{min_o}$ of the motor of linear compressor 100 is calculated. As an example, the observed minimum velocity $\dot{x}_{min_o}$ may be obtained using the methodology described in U.S. Patent Publication No. 2016/0215770, which is hereby incorporated by reference in its entirety. Thus, the observed minimum velocity $\dot{x}_{min_o}$ may be calculated using at least an electrical dynamic model for the motor of the linear compressor and a robust integral of the sign of the error (RISE) feedback. At step 920, an observed stroke length, $SL_o$, of the motor of linear compressor 100 is also calculated. The observed stroke length $SL_o$ may also be obtained using the methodology described in U.S. Patent Publication No. 2016/0215770, Thus, the observed stroke length $SL_o$ may be calculated using at least an electrical dynamic model for the motor of the linear compressor and a robust integral of the sign of the error (RISE) feedback.

At step 930, a set of predictors is established. The set of predictors may include the peak motor voltage $V_p$, the excitation frequency f, the peak motor current $i_p$, the observed minimum velocity $\dot{x}_{min_o}$, the observed stroke length $SL_o$, etc. The set of predictors may also include each product between two of the peak motor voltage $V_p$, the excitation frequency f, the peak motor current $i_p$, the observed minimum velocity $\dot{x}_{min_o}$, and the observed stroke length $SL_o$. The set of predictors may further include each square of the peak motor voltage $V_p$m the excitation frequency f, the peak motor current $i_p$, the observed minimum velocity $\dot{x}_{min_o}$, the observed stroke length $SL_o$. Thus, e.g., the set of predictors may include at least twenty (20) predictors.

At step 930, redundant predictors from the set of predictors are removed in order to establish a reduced set of predictors. An example, covariance testing may be conducted on the set of predictors in order to establish a reduced set of predictors by removing highly correlated predictors from the set of predictors. After removing redundant predictors, the reduced set of predictors may include or consist of the peak motor voltage $V_p$, the excitation frequency f, the peak motor current $i_p$, the observed minimum velocity $\dot{x}_{min_o}$, the observed stroke length $SL_o$, a product of the peak motor voltage $V_p$ and the excitation frequency f, a product of the peak motor voltage $V_p$ and the observed stroke length $SL_o$, and a product of the excitation frequency f and the observed minimum velocity $\dot{x}_{min_o}$.

It will be understood that various operating parameters of the linear compressor 100 may be modified to provide suitable data and/or measurements for the predictors within the set of predictors. For example, a peak current, a suction pressure and/or a discharge pressure of the linear compressor 100 may be adjusted to provide data and/or measurements for the predictors within the set of predictors across a variety of operating conditions for linear compressor 100. By varying the operating parameters of the linear compressor 100 and collecting data and/or measurements for the predictors within the set of predictors, performance of method 900 to estimate head clearance of linear compressor 100 may be improved.

At step 940, a model is established for an estimated head clearance of linear compressor 100 with the reduced set of predictors. The model for the estimated head clearance of linear compressor 100 may be established at step 940 by conducting a best subsets regression with the reduced set of predictors from step 930. As an example, the model for the estimated head clearance of linear compressor 100 may be a linear combination of each predictor of the reduced set of predictors. Thus, each predictor from the reduced set of predictors may be multiplied by a respective coefficient. The linear combination may also include a constant. At step 950, the coefficients of the model for the estimated head clearance of linear compressor 100 may be calculated. The coefficients of the model for the estimated head clearance of linear compressor 100 may be calculated using a least-squares method, e.g., and measured head clearance values.

Figure 11:
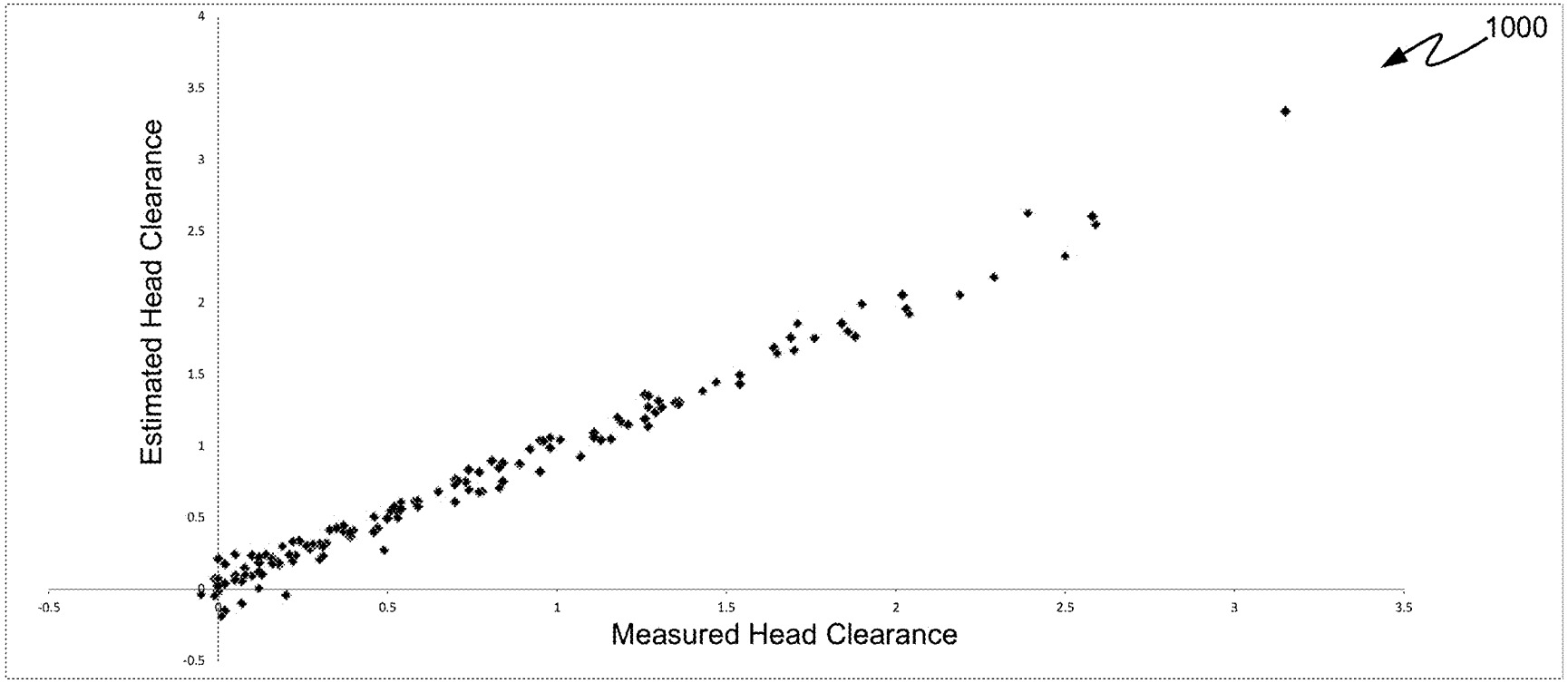
FIG. 11 illustrates an exemplary plot of a measured head clearance for a linear compressor versus an estimated head clearance for the linear compressor.

FIG. 11 illustrates an exemplary plot 1000 of a measured head clearance for linear compressor 100 versus an estimated head clearance for linear compressor 100. The estimated head clearance in FIG. 11 is calculated with the model for the estimated head clearance of linear compressor 100 from step 940 of method 900. The measured head clearance for linear compressor 100 is received from a sensor. As may be seen in FIG. 11, the model for the estimated head clearance of linear compressor 100 provided by method 900 may accurately estimate the head clearance of linear compressor 100 during operation of linear compressor 100. In particular, the plot of FIG. 11 generally shows a one-to-one correspondence between the measured head clearance for linear compressor 100 and the estimated head clearance for linear compressor 100 at various operating conditions of linear compressor 100.

The model for the estimated head clearance of linear compressor 100 from step 940 and the coefficients from step 950 may be saved in the memory of the controller of linear compressor 100. Thus, the model for the estimated head clearance of linear compressor 100 may be used by the controller during operation of linear compressor 100, e.g., to adjust operation of linear compressor towards a desired head clearance, such as the reference clearance $c_{ref}$ of the clearance controller 730. Thus, the desired head clearance may be established and the peak motor current $i_p$ and/or peak motor voltage $V_p$ may be adjusted until the estimated head clearance of the linear compressor from the model for the estimated head clearance of linear compressor 100 is about equal to the desired head clearance.

The model for the estimated head clearance of linear compressor 100 may be used with the clearance controller 730 to adjust operation of linear compressor 100, with the estimated head clearance from the model for the estimated head clearance of linear compressor 100 corresponding to the observed clearance $\hat{c}$ described above. The motor of linear compressor 100 may be sealed within the hermetic shell during operation of the linear compressor 100 with the clearance controller 730. Thus, by generating and using the model for the estimated head clearance of linear compressor 100, a sensor to directly measure an actual head clearance during operation of linear compressor 100 may not be included or required.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for operating a linear compressor, comprising: supplying a motor of the linear compressor with a time varying voltage having a peak motor voltage and an excitation frequency; measuring a peak motor current of the linear compressor while the time varying voltage is supplied to the motor of the linear compressor; determining an observed minimum velocity of the motor of the linear compressor and an observed stroke length of the motor of the linear compressor, wherein a set of predictors comprises the peak motor voltage, the excitation frequency, the peak motor current, the observed minimum velocity and the observed stroke length; removing redundant predictors from the set of predictors in order to establish a reduced set of predictors; establishing a model for an estimated head clearance of the linear compressor with the reduced set of predictors, the model for the estimated head clearance of the linear compressor is a linear combination of each predictor of the reduced set of predictors with each predictor from the reduced set of predictors being multiplied by a respective coefficient; establishing a value for each coefficient of the model for the estimated head clearance of the linear compressor; and saving the coefficients and the model for the estimated head clearance of the linear compressor in a memory of a controller such that the controller is configured operable to adjust operation of the linear compressor towards a desired head clearance using the model for the estimated head clearance of the linear compressor, wherein the linear compressor does not have a position sensor for detecting a position of a piston of the linear compressor.

2. The method of claim 1, wherein determining the observed minimum velocity of the motor of the linear compressor and the observed stroke length of the motor of the linear compressor comprises:

estimating a back-EMF of the motor of the linear compressor using an electrical dynamic model for the motor of the linear compressor and a robust integral of the sign of the error feedback;

determining an observed velocity of the motor of the linear compressor based at least in part on the back-EMF of the motor; and calculating the observed stroke length of the motor of the linear compressor based at least in part on the observed velocity of the motor.

3. The method of claim 2, wherein the electrical dynamic model for the motor comprises $$\frac{di}{dt} = \frac{v_a}{L_i} - \frac{r_i i}{L_i} - \frac{\alpha \dot{x}}{L_i}$$

where $v_a$ is a voltage across the motor of the linear compressor;

$r_i$ is a resistance of the motor of the linear compressor;

i is a current through the motor of the linear compressor;

$\alpha$ is a motor force constant;

$\dot{x}$ is a velocity of the motor of the linear compressor;

t is time; and $L_i$ is an inductance of the motor of the linear compressor.

4. The method of claim 3, wherein estimating the back-EMF of the motor of the linear compressor using the robust integral of the sign of the error feedback comprises solving $$\hat{f} = (K_1+1)e(t) + \int_{t_0}^{t}[(K_1+1)e(\sigma) + K_2 \operatorname{sgn}(e(\sigma))]d\sigma - (K_1+1)e(t_0)$$

where $\hat{f}$ is an estimated back-EMF of the motor of the linear compressor;

$K_1$ and $K_2$ are real, positive gains;

e is an error given as $\hat{\iota} - i$;

$\hat{\iota}$ is an observed current through the motor of the linear compressor;

$e(\sigma)$ is e as a function of $\sigma$;

e(t) is e as a function of time; and $e(t_0)$ is e at time $t_0$.

5. The method of claim 1, further comprising:

establishing the desired head clearance of the linear compressor;

calculating the estimated head clearance of the linear compressor with the model for the estimated head clearance of the linear compressor; and adjusting the peak motor current of the linear compressor in order to reduce a difference between the desired head clearance of the linear compressor and the estimated head clearance of the linear compressor.

6. The method of claim 5, wherein the motor of the linear compressor is sealed within a hermetic shell prior to the desired head clearance is established, the estimated head clearance is calculated, and the peak motor current is adjusted.

7. The method of claim 5, wherein the controller establishes the desired head clearance, calculates the estimated head clearance, and adjusts the peak motor current.

8. The method of claim 1, wherein the set of predictors further comprises at least one product of any two of the peak motor voltage, the excitation frequency, the peak motor current, the observed minimum velocity and the observed stroke length.

9. The method of claim 1, wherein the set of predictors further comprises one or more of the square of the peak motor voltage, the square of the excitation frequency, the square of the peak motor current, the square of the observed minimum velocity and the square of the observed stroke length.

10. The method of claim 1, wherein the set of predictors further comprises:

each product of two of the peak motor voltage; the excitation frequency, the peak motor current, the observed minimum velocity and the observed stroke length; and each respective square of the peak motor voltage, the excitation frequency, the peak motor current, the observed minimum velocity and the observed stroke length.

11. The method of claim 1, wherein the reduced set of predictors further comprises a product of the peak motor voltage and the excitation frequency, a product of the peak motor voltage and the observed stroke length; and a product of the excitation frequency and the observed minimum velocity.

12. The method of claim 1, wherein establishing the model for the estimated head clearance comprises conducting a best subsets regression with the reduced set of predictors.

13. The method of claim 1, wherein establishing the coefficients of the model for the estimated head clearance comprises establishing the coefficients of the model for the estimated head clearance with a least-squares method.

14. A method for operating a linear compressor, comprising: supplying a motor of the linear compressor with a time varying voltage having a peak motor voltage and an excitation frequency; measuring a peak motor current of the linear compressor while the time varying voltage is supplied to the motor of the linear compressor; determining an observed minimum velocity of the motor of the linear compressor and an observed stroke length of the motor of the linear compressor; establishing a set of predictors, the set of predictors comprising the peak motor voltage, the excitation frequency, the peak motor current, the observed minimum velocity, the observed stroke length, a product of the peak motor voltage and the excitation frequency, a product of the peak motor voltage and the observed stroke length, and a product of the excitation frequency and the observed minimum velocity; establishing a model for an estimated head clearance of the linear compressor by conducting a best subsets regression with the set of predictors, the model for the estimated head clearance of the linear compressor is a linear combination of each predictor of the set of predictors with each predictor from the set of predictors being multiplied by a respective coefficient; and establishing a value for each coefficient of the model for the estimated head clearance of the linear compressor; and saving the coefficients and the model for the estimated head clearance of the linear compressor in a memory of a controller such that the controller is configured to adjust operation of the linear compressor towards a desired head clearance using the model for the estimated head clearance of the linear compressor, wherein the linear compressor does not have a position sensor for detecting a position of a piston of the linear compressor.

15. The method of claim 14, further comprising:

establishing the desired head clearance of the linear compressor;

calculating the estimated head clearance of the linear compressor with the model for the estimated head clearance of the linear compressor; and adjusting the peak motor current of the linear compressor in order to reduce a difference between the desired head clearance of the linear compressor and the estimated head clearance of the linear compressor.

16. The method of claim 14, wherein the motor of the linear compressor is sealed within a hermetic shell prior to the desired head clearance is established, the estimated head clearance is calculated, and the peak motor current is adjusted.

17. The method of claim 14, wherein establishing the coefficients of the model for the estimated head clearance comprises establishing the coefficients of the model for the estimated head clearance with a least-squares method.

* * * * *